US007404667B2

(12) United States Patent
Born et al.

(10) Patent No.: US 7,404,667 B2
(45) Date of Patent: Jul. 29, 2008

(54) MAGNETIC CONTROL DEVICE FOR TIMEPIECE

(75) Inventors: Jean-Jacques Born, Morges (CH); François Gueissaz, Wavre (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 11/937,660

(22) Filed: Nov. 9, 2007

(65) Prior Publication Data

US 2008/0112275 A1 May 15, 2008

(30) Foreign Application Priority Data

Nov. 9, 2006 (EP) ..... 06123744

(51) Int. Cl.
*G04B 27/02* (2006.01)
*G04B 29/00* (2006.01)
*G04B 37/00* (2006.01)

(52) U.S. Cl. ..... 368/190; 368/308; 368/321

(58) Field of Classification Search ..... 368/69, 368/190, 288–290, 308–321
See application file for complete search history.

(56) References Cited

U.S. PATENT DOCUMENTS 3,782,102 A * 1/1974 Bergey ..... 368/226
3,789,601 A * 2/1974 Bergey ..... 368/69
4,038,814 A 8/1977 Niida
6,134,189 A * 10/2000 Carrard ..... 368/69
6,799,886 B2 * 10/2004 Carrard et al. ..... 368/281
7,016,263 B2 * 3/2006 Gueissaz et al. ..... 368/10
2003/0206493 A1 * 11/2003 Carrard et al. ..... 368/10

FOREIGN PATENT DOCUMENTS

DE 43 33 098 1/1995
FR 2 513 807 4/1983

OTHER PUBLICATIONS

European Search Report issued in corresponding application No. EP 06 12 3744, completed Apr. 4, 2007.

* cited by examiner

*Primary Examiner*—Vit W Miska
(74) *Attorney, Agent, or Firm*—Griffin & Szipl, P.C.

(57) ABSTRACT

The magnetic control device (1) for a timepiece comprises a sealed tube (3) which comprises a blind end inserted into an opening of the timepiece, whereas the other end of the tube opens towards the outside. A control stem (12) is provided in order to slide inside the tube (3). It carries a magnet (21) which is displaced integrally with the stem inside the tube. By manipulating the end of the stem which emerges from the tube (3), the wearer of the watch can make the magnet selectively occupy three positions. A first and a second magnetic sensor (22, 23) with two states are disposed inside the timepiece along the sealed tube so that three different combinations of a state of the first sensor (22) with a state of the second sensor (23) are respectively associated with three predefined positions of the first magnet (21).

15 Claims, 4 Drawing Sheets

MAGNETIC CONTROL DEVICE FOR TIMEPIECE

This application claims priority from European Patent Application No. 06123744.2, filed Nov. 9, 2006, the entire disclosure of which is incorporated herein by reference.

FIELD OF THE INVENTION

The present invention relates to a magnetic control device for a timepiece and more particularly to a magnetic device comprising a manually actuatable control member and able to occupy selectively a plurality of positions and to move from one to the other via a translational movement.

BACKGROUND OF THE INVENTION

Such magnetic control devices are already known to the person skilled in the art. The patent document U.S. Pat. No. 4,038,814 describes in particular several embodiments of such a device. In particular, the embodiment described with reference to FIGS. 6 and 7 relates to a wristwatch of a generally rectangular exterior form, and one of the sides of which carries a guide rail. A plastic cursor containing a magnet is provided in order to slide along this rail. A non-specified number of reed contacts are disposed inside the watch facing the guide rail. By making the magnet slide, the wearer of the watch can selectively close one or other of the reed contacts and thus can control the watch. This control device functions therefore without mechanical or electrical connection between the outside and the inside of the watch.

This device of prior art has certain defects. First of all it is not unobtrusive since the guide rail extends practically over the entire length of one of the sides of the watch. Furthermore it does not appear that it is possible to reduce greatly the size of this prior art device. In fact the described configuration makes it necessary to dispose all the reed contacts side by side in one line. However, the width of the smallest reed contacts known approaches a millimeter. Furthermore, the magnetic field must be intense enough to act through the thickness of the middle part of the watch. In these conditions it is necessary to space the contacts sufficiently apart in order that two contacts are not closed at the same time.

One object of the present invention is therefore to provide a control device which functions without a mechanical or electrical connection between the outside and the inside of the timepiece and which is more compact than those of prior art.

Another object of the present invention is to provide a control device within which the amplitude of the translational movement which the control member must perform is greatly reduced.

Another object is to provide a magnetic control device which can have the exterior appearance of a traditional mechanical control device.

Yet another object of the present invention is to provide a magnetic control device, the control member of which can be adapted easily in order to be actuated equally in rotation, in the manner of a traditional control stem.

SUMMARY OF THE INVENTION

The present invention achieves these objectives by providing a magnetic control device of a timepiece that includes a moveable control member which can be actuated manually from the outside of the timepiece, and a first magnet which is fixed to the control member, the first magnet being provided in order to be displaced in translation on a trajectory connecting at least three predefined positions when the wearer of the watch manipulates the control member, the device also comprising detection means situated inside the timepiece and provided in order to detect, amongst the three predefined positions, the position occupied by the first magnet, the detection means comprising at least one first and one second magnetic sensor which are able to be in a first or a second state (yes or no), and disposed in the vicinity of the trajectory of the first magnet in order to cooperate with the latter; the device being wherein it comprises a sealed tube which has a wall produced in a non-magnetic material, the sealed tube comprising a distal blind end which extends towards the inside of the timepiece and a proximal end which opens towards the outside of the timepiece, the device also being wherein the control member has the general form of a stem provided in order to slide inside the sealed tube and wherein the first magnet is provided in order to be displaced inside the tube solid with the stem, the first and the second magnetic sensor being disposed spaced-apart along the sealed tube, in order that the three predefined positions of the first magnet are respectively associated with three different combinations of a state of the first sensor with a state of the second sensor.

Contrary to the watch casing itself, the sealed tube is protected from possible impacts. The wall of the tube therefore does not need to be as thick as the exterior wall of the timepiece. Hence it is possible to arrange the reed contacts at a small distance from the trajectory of the magnet, in a high field gradient zone. As a consequence, an advantage of the present invention resides in the possibility of providing a device which is capable of detecting even a small displacement of the magnet.

Another advantage of the present invention is that the stem and the first magnet are inserted into the sealed tube. In these conditions, only the end of the stem which emerges from the timepiece is visible. Hence, the magnet and the remainder of the control device are not visible. It is therefore possible to provide a control device which has the appearance of a traditional control stem.

Another advantage of the present invention is that two magnetic sensors suffice to allow the electronic means to distinguish three positions of the first magnet (and even four positions according to one variant). Thanks to this feature, the control device according to the invention can be more compact. On the other hand, the fact of limiting the number of magnetic sensors makes it possible to reduce the cost price.

According to an advantageous variant of the present invention, the positions of the first and of the second reed contact are offset angularly relative to the axis of the sealed tube. The contacts therefore not being disposed in the extension one of the other, free choice of their spacing in the direction of the longitudinal axis of the stem is possible, without having to take into account possible interferences between contacts. According to this variant, it is therefore possible to produce a control device within which the amplitude of the translational movement which the control member must perform is reduced to the minimum.

BRIEF DESCRIPTION OF THE DRAWINGS

Other features and advantages of the present invention will appear upon reading the description which will follow, given solely by way of non-limiting example and with reference to the annexed drawings in which.

DETAILED DESCRIPTION OF THE INVENTION

Figure 1A:
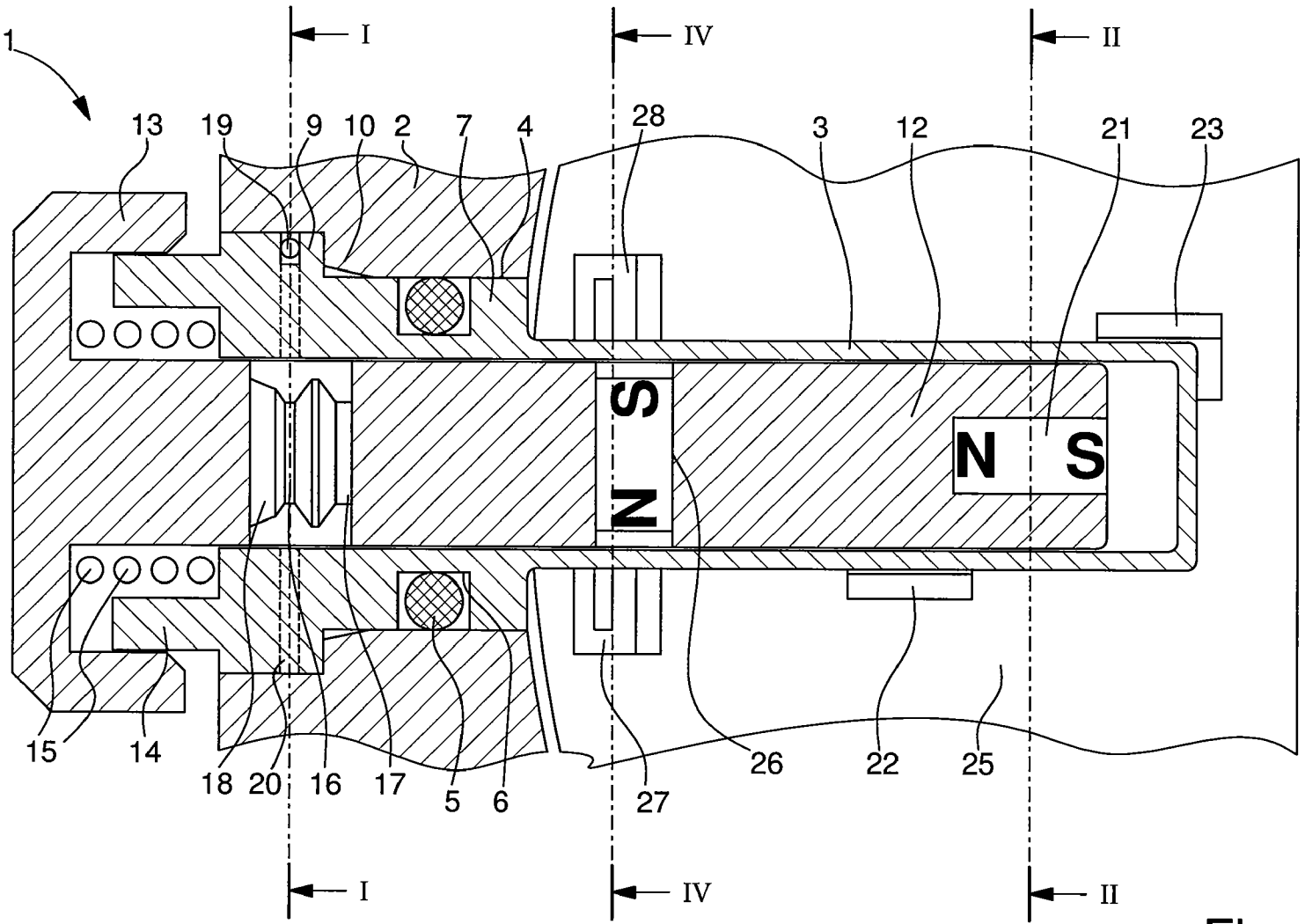
FIG. 1A is a view from above in section of a magnetic control device for a timepiece according to a particular embodiment of the invention.

FIG. 1A represents a particular embodiment of the control device according to the present invention. In this example, the magnetic control device 1 is mounted in the middle part 2 of a watch. It can be seen in the drawing that a tube (reference number 3) is inserted into an opening 4 provided in the edge of the middle part 2. The tube 3 is produced in a non-magnetic material, such as stainless steel for example. The tube is airtight and is open at only one of its ends. It can be seen in FIG. 1A that, in the embodiment which is the subject of the present example, the tube 3 is practically entirely contained inside the middle part. Only the open end of the tube opens to the exterior of the watch. However it will be understood that, according to other embodiments of the present invention, it is possible that only the distal part of the tube, near the closed end (or blind end), is inserted in the middle part. In these conditions, the proximal part of the tube, close to the open end, would extend out from the middle part, thus raising the button 13.

It can be seen that, in the part of the tube 3 situated near its open end (termed hereafter proximal part of the tube, and with the reference number 7), the wall of the tube has a greater thickness. This part 7 is formed in order to be adjusted in the opening 4 of the middle part so as to form a seal which is as tight as possible. On the other hand, as FIG. 1A shows again, the impermeability is reinforced by a seal of the "O-ring" type (reference number 5) which is disposed in an annular groove 6 likewise provided in the part 7. The part 7 again has an exterior circular shoulder 9 provided to abut on a complementary shoulder 10 of the opening 4. A recess 14 is again seen in FIG. 1A, provided in the proximal end of the tube. This recess is provided for receiving a helical spring 15.

According to the present embodiment, the tube 3 extends radially from the edge of the middle part 2 in the direction of the centre of the watch. It will be understood therefore that the presence of the tube could constitute an obstacle for introducing certain components into the watch casing during assembly of the watch. In particular, in the case of an analogue watch, the tube 3 could constitute an obstacle during introduction of the movement into the casing. In order to avoid this type of problem, it is possible to provide placing the tube in position only after installation of the other elements which have to be placed in the watch casing. Once the tube is inserted, it can remain in place once and for all. The joint between the tube 3 and the middle part 2 is therefore a static joint. In these conditions, the sealing means which will be described make it possible to ensure long term impermeablity.

In the present example, the manual control member of the device according to the invention is formed by a cylindrical stem 12 which is inserted into the tube 3. The stem 12 is provided in order, both, to slide and to turn inside the tube 3. One of the ends of the stem 12 emerges from the tube via the opening 4 and, as can be seen in the Figure, this end terminates with a button 13 in the form of a crown. It can be seen likewise that the button 13 has, on its lower face, an annular recess in which the cylindrical proximal end of the tube 3 and the helical spring 15 come to be accommodated. It can be seen that the button 13 covers the proximal end and the spring 15 in the manner of a cap. The exterior cylindrical face of the proximal end of the tube is designed to slide inside the annular recess of the button in order to vary the degree of nesting of the tube 3 and of the button 13. The button being integral with the stem 12, this axial movement of the button relative to the tube 3 causes the displacement of the stem 12 in the tube.

The return spring 15 is a helical spring which is supported by one of its ends against the bottom of the annular recess of the button 13, and by its other end against the bottom of the recess 14. In these conditions, when the wearer of the watch presses on the button 13, he compresses the return spring 15 and causes the proximal end of the tube 3 to sink into the annular recess. Then, when the wearer of the watch releases his pressure on the button 13, the return spring 15 has the tendency to return the button 13 and the stem 12 into their initial position.

Figure 1B:
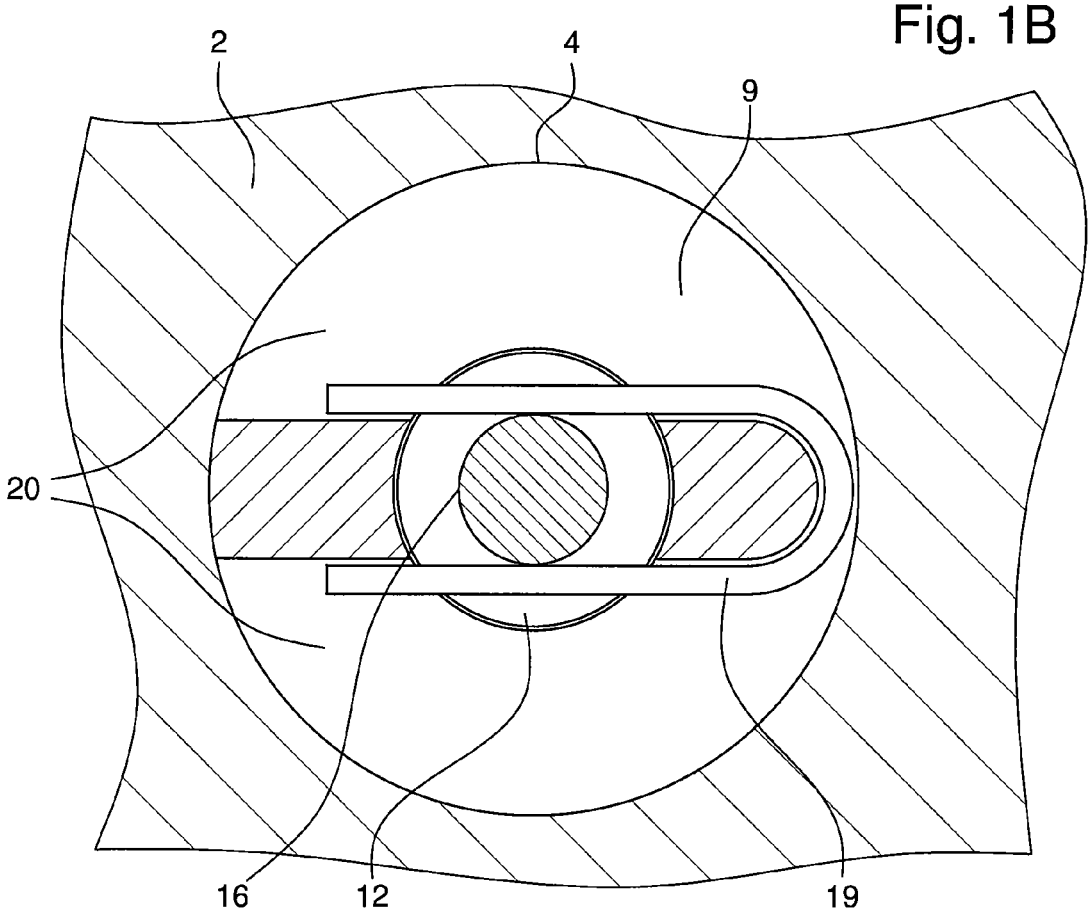
FIG. 1B is a transverse section according to the axis 1-1 of FIG. 1A.

It can be seen again in FIG. 1 that the stem 12 has a profiled section of a substantially lesser diameter than that of the rest of the stem. This profiled section, situated at the level of the proximal part 7 of the tube, is essentially formed by two grooves (reference numbers 16 and 17) and by an inclined part 18. The two grooves 16, 17 and the inclined part 18 are provided in order to cooperate with a circlip 19 in order to form indexing means which serve to maintain or return the stem into a selected axial position. The tube 3 has a double symmetrical milling 20 which is provided in order to allow the two branches of the circlip 19 to pass and in order to maintain the latter in place. Corresponding to what is represented in FIG. 1B, the stem 12 extends between the two branches of the circlip.

Following the example of what is known with traditional winding-buttons with push-piece, by pressing or pulling on the button 13, the wearer of the watch can move the stem 12 of the magnetic control device 1 of the present example to occupy three different predefined positions selectively:

- a first position (termed resting position or position "0") in which the circlip is engaged in the first groove with the reference number 16;
- a second position (termed pulled position or position "1") in which the circlip is engaged in the second groove with the reference number 17;
- a third position (termed pushed position or position "−1") in which the circlip cooperates with the inclined part 18.

In this transitory position, the stem 12 is returned into the resting position, via the combined effect of the inclined part 18 and the return spring 15 as soon as the wearer of the watch releases his pressure on the button 13.

Figure 2A:
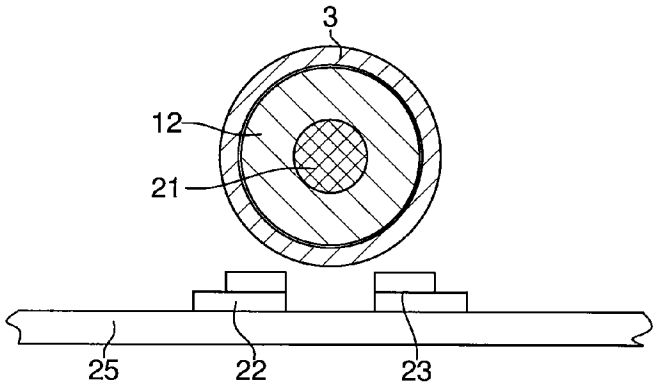
FIG. 2A is a transverse section according to the axis 2-2 of FIG. 1A.

According to the present invention, a first magnet (reference number 21) which is integral with the stem 12 can be displaced in translation inside the sealed tube 3. This magnet 21 is provided in order to cooperate, through the wall of the tube, with a first and second magnetic sensor, placed inside the timepiece. These magnetic sensors which can be reed microcontacts, are designated hereafter by the abbreviation MR and respectively with the reference numbers 22 and 23. As can be seen in FIG. 1A, these two MR are arranged spaced apart along the sealed tube 3 so that they are situated at unequal distances from the distal end of the tube. As can be seen in FIGS. 1A and 2A, in the present example, the first magnet 21 is inserted coaxially into a boring formed in the end of the stem. A support plate 25 which carries the first and the second MR 22 and 23 is also seen in the Figures. As will be seen further on, this support plate 25 can advantageously be formed by the printed circuit board 25 of the electronic circuit of the watch.

A reed microcontact (or MR) is a contact which is sensitive to the magnetic field. The MR can be in two states. In fact it closes in the presence of a field, the component of which in the direction of the axis of the MR is sufficiently intense. In the opposite case, when the value of the component of the field in the direction of the axis of the MR does not exceed a certain threshold, the contact remains open. An MR is suitable therefore to be used as a magnetic sensor with two states in order to detect the presence of a magnetic field, the intensity of which in a given direction exceeds a certain value.

According to the variant of the invention which is the subject of the present example, the MR 22 and 23 are orientated with their axis parallel to the axis of the sealed tube 3 and therefore likewise orientated parallel to the north-south axis of the first magnet 21. An advantage associated with the parallel orientation of the MR 22 and 23 and of the magnet 21 will now be explained with reference to FIG. 2B. This Figure is a graph indicating the variation in intensity of the magnetic flux of the field inside the blades of a reed microcontact as a function of the longitudinal position occupied by the magnet. As can be observed, the graph comprises in fact two curves. The first curve, in continuous lines, corresponds to the values calculated for the case where the MR is closed (the two blades of the MR therefore being in contact). The second curve, in broken lines, corresponds to the case where the MR is open. It can be verified in particular that the intensity of the flux is always greater when the MR is closed. On the other hand it can be seen that the magnetic flux reaches its maximum in the centre of the graph at the point of the zero abscissa. This zero abscissa point corresponds to the situation where the magnet and the MR are side by side. It can be observed that, in this central region of the graph, the intensity of the magnetic flux is represented as being negative. This feature corresponds to the fact that, when the magnet and the MR are side by side, the magnetisation of the blades of the MR is in the opposite direction from the polarisation of the magnet.

Figure 2B:
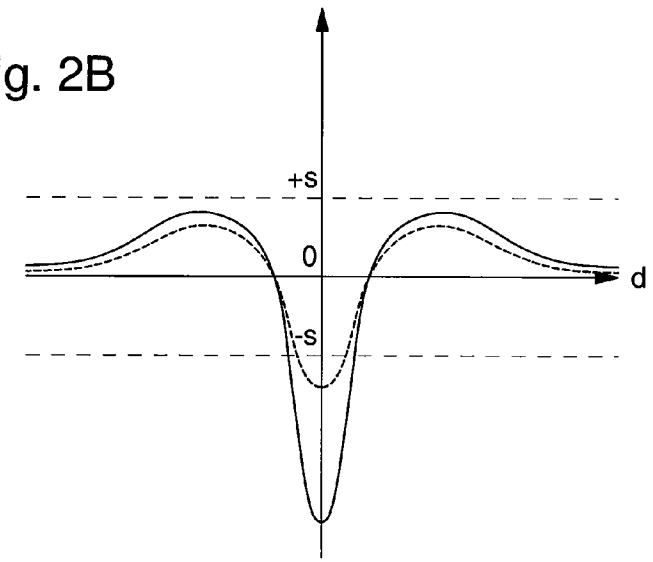
FIG. 2B is a graph of the magnetic flux in the blades of a reed microcontact as a function of the position of the magnet.

The two horizontal lines disposed at equal distances above and below the zero ordinate in FIG. 2B indicate the sensitivity threshold of the MR. In the present example it can be seen that the force of the magnet has been chosen, simultaneously, to be big enough that the intensity of the flux broadly exceeds the closure threshold in the centre of the graph, and small enough that the intensity of the flux remains below the threshold everywhere else. In effect it is seen that, the magnitude of the intensity of the magnetic flux decreases rapidly as the magnet is displaced relative to the MR. To such an extent that the intensity of the magnetic flux rapidly reaches the value zero on both sides of the zero abscissa, before increasing again to reach two local maxima of inferior amplitude. As will be seen even further on, the existence of two positions, situated at a relatively short distance from the maximum and where the magnetic flow is zero, is due not to the weakness of the magnetic field but to the orientation of the field lines which are perpendicular to the axis of the MR. An advantage of this feature will now be explained with reference to FIGS. 1A and 3A. In these Figures, the position of the first magnet 21 corresponds to the resting position (position 0) of the stem 12. In the resting position, it is seen that the first and the second MR 22 and 23 are disposed symmetrically relative to the magnet 21 which is situated therefore at half the distance between the two. It can be observed moreover in FIG. 3A that the position of the MR 22 and 23 corresponds to two positions where the field lines are substantially perpendicular to the axes of the MR. It was seen further back that a perpendicular orientation of the field lines made the magnetic flux in the axis of the MR equal to zero. The represented configuration therefore corresponds to a situation where the two MR are open. Furthermore, in the light of the preceding, it will be understood that the fact that the two MR are open is explained above all by geometric considerations and only depends marginally upon the intensity of the magnetic field. An advantage of this state of affairs is that it makes it possible to produce the invention on a large scale with normal manufacturing tolerances without excessive concerns about the possible consequences stemming from a variation in sensitivity between specimens.

The two MR 22 and 23 are therefore disposed at positions where the orientation of the field lines is substantially perpendicular to the axis of the magnet 21. More detailed examination of the distribution of the field lines makes it possible to be aware that the longitudinal spacing between the two MR corresponds to the width of one of the loops drawn by these field lines. Hence, in the present example, the more the axes of the MR are distant from the axis of the magnet, the more the MR must be spaced apart longitudinally. Therefore, it will be understood that, thanks to using the tube 3 which has a wall of a low thickness and therefore makes it possible to have the MR close to the axis of the stem, it is possible to reduce considerably the distance separating the three predefined positions "1", "0" and "−1" of the magnet 21 and therefore to shorten considerably the travel of the stem 12.

Figure 3A:
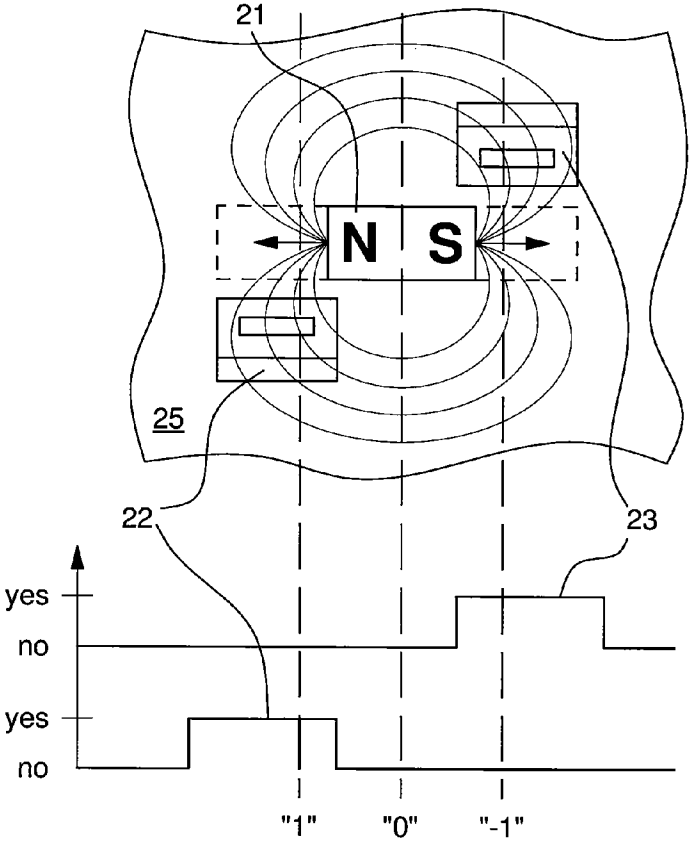
FIG. 3A is a view from above showing the configuration of the magnet and first and second reed contacts according to a first variant of the embodiment of FIG. 1A.

The position of the magnet 21 represented in continuous lines in FIG. 3A corresponds to the resting position (0) of the stem. However, the positions of the magnet corresponding to the pulled position (1) and the pushed position (−1) are represented again by two rectangles in broken lines. The Figure shows that when the stem 12 is in the pulled position, the magnet is situated in the direct vicinity of the first MR 22. In this position, the magnetic field suffices to close the MR 22. The second MR 23, for its part, is sufficiently distanced from the magnet 21 in order to be open in this position. When the stem 12 is in the pushed position, the situation is reversed. In position (−1), the magnet 21 is situated in the direct vicinity of the second MR 23. The MR 23 is therefore closed whilst the first MR 22 is open. It is seen again in FIG. 3A that in the pulled position "1", the magnet 21 and the MR 22 are not quite side by side. In fact, insofar as the force of the magnet is adapted to the sensitivity of the MR, the magnetic field is sufficient to close the MR even when there is a certain offset between the latter and the magnet. Hence, corresponding to what is represented in FIG. 3A, the travel of the stem 12 or, in other words, the distance separating the pulled position "1" from the pushed position "−1" can be considerably shorter than the spacing between the MR 22 and 23.

Figure 3C:
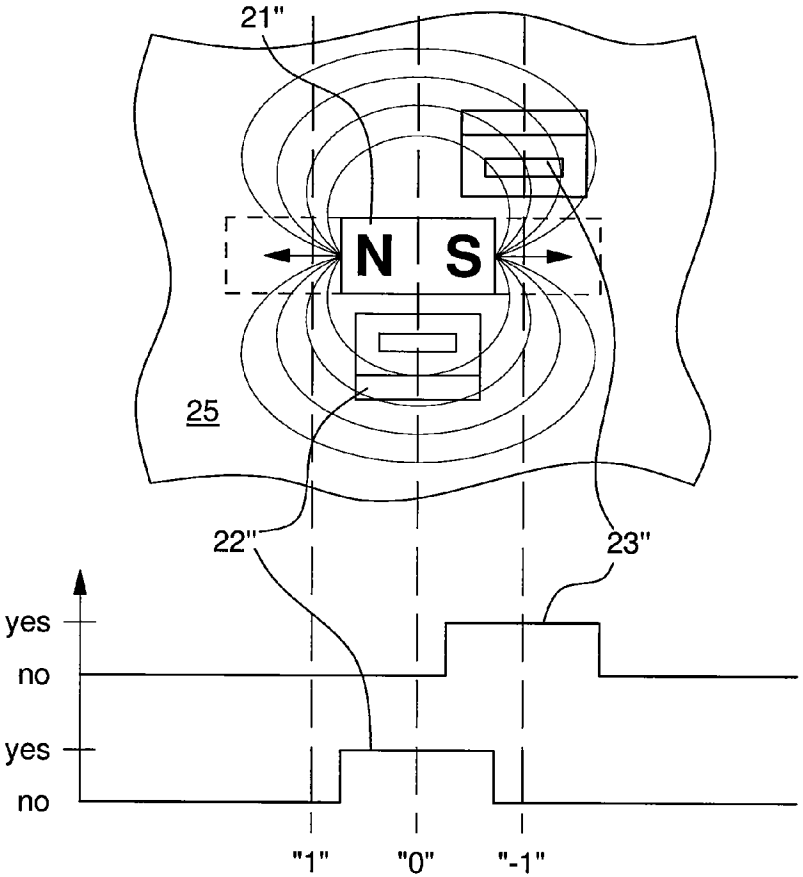
FIG. 3C is a view from above showing the configuration of the magnet and first and second reed contacts according to a fourth variant of the embodiment of FIG. 1.
Figure 3B:
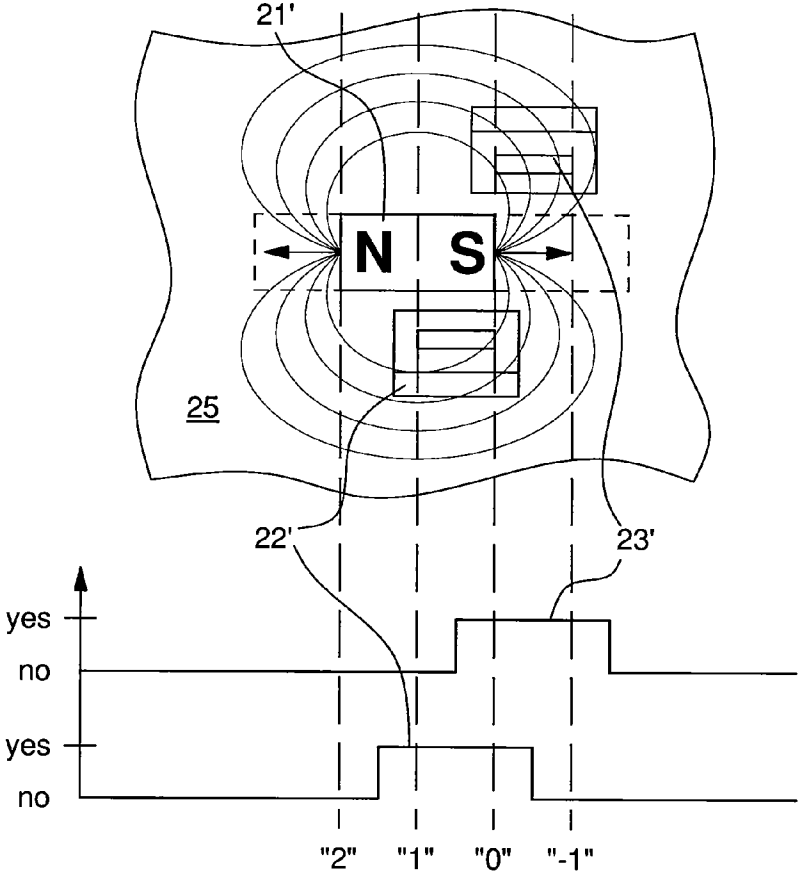
FIG. 3B is a view from above showing the configuration of the magnet and first and second reed contacts according to a second variant of the embodiment of FIG. 1.

FIG. 3B represents the configuration of the magnet 21' and of the MR 22' and 23' according to a second variant. As in the preceding variant, the two MR are disposed symmetrically on both sides of the resting position "0" of the magnet. However, in the variant of FIG. 3B, the two MR 22' and 23' are much closer so that, in the resting position, they are both closed. The position of the magnet 21' represented in continuous lines in FIG. 3B corresponds to the pulled position (1) of the stem. It can be seen in the Figure that the position of the MR 23' corresponds to a position where the orientation of the field lines is substantially perpendicular to the axis of the MR. In the pulled position "1", the MR 23' is therefore open. The MR 22', for its part, is closed. On the other hand, it will be understood that because of the symmetrical disposition of the two MR, the MR 22' is open and the MR 23' closed in the pushed position "−1" of the magnet 21'. According to this second variant, the travel of the stem is very slightly longer than in the preceding variant. However, the variant of FIG. 3B has the advantage of making it possible to have a predefined fourth position of the magnet (reference number "2" in the Figure). In this fourth predefined position, a second pulled position for example, the two MR are open. FIG. 3B likewise makes it possible to imagine again a third variant with three predefined positions. In fact, if for one reason or another the length of the sealed tube 3 must be limited, it can be advantageous not to use the position with the reference number "−1" in the Figure and to limit the travel of the magnet 21' to the interval between the positions "2" and "0".

FIG. 3C represents the configuration of the magnet 21" and of the MR 22" and 23" according to a fourth variant. Like the third variant, the fourth is an asymmetric variant, which is compatible for example, with use of a sealed tube 3 of a small length. The position of the magnet 21" represented in continuous lines in FIG. 3C corresponds to the resting position "0" of the stem. It can be seen in the Figure that the position of the MR 23" corresponds to a position where the orientation of the field lines is substantially perpendicular to the axis of the MR. In the resting position "0", the MR 23" is therefore open. The MR 22", for its part, is situated directly opposite the magnet. It is therefore closed. On the other hand, it will be understood that for reasons of symmetry the situation is reversed in the pushed position "−1". In this position, the MR 23" is therefore closed and the MR 22" open. Finally, in the pulled position "1" of the magnet 21", the field lines are perpendicular to the axis of the MR 22" which is therefore open. The second MR 23" is, for its part, sufficiently distanced from the magnet MR 21" to be likewise open.

It will be understood that the MR described in the present example must be of a small dimension. However, MR exist which are sufficiently small to be suitable for such applications. There may be cited in particular the MicroReed-14 developed by the company ASULAB SA, CH-2074 Marin, Switzerland.

On the other hand, it will be understood that various modifications and/or improvements which are evident to the person skilled in the art can be provided in the embodiment which is the subject of the present description without departing from the scope of the present invention defined by the annexed claims. In particular, the length of the travel between the resting position and the pushed position does not require to be equal to that between the resting position and the pulled position. On the other hand, the present invention is obviously not limited to embodiments which use reed contacts as magnetic sensors. A priori, any sensor which is sensitive to the intensity of a magnetic field is suitable for use in the present invention. It is possible in particular to use Hall-effect sensors.

The continuation of the description will be given with reference to the first variant (FIG. 3A) of the embodiment of FIG. 1A. According to this variant, as has been seen, the first magnet 21 can be brought by the stem 12 to occupy selectively the three following predefined axial positions:

- position (0) (corresponding to the resting position of the stem 12) in which the first and the second MR 22, 23 are both open;
- position (1) (corresponding to the pulled position of the stem 12) in which the first MR 22 is closed and the second MR 23 is open;
- position (−1) (corresponding to the pushed position of the stem 12) in which the first MR 22 is open and the second MR 23 is closed.

Figure 4:
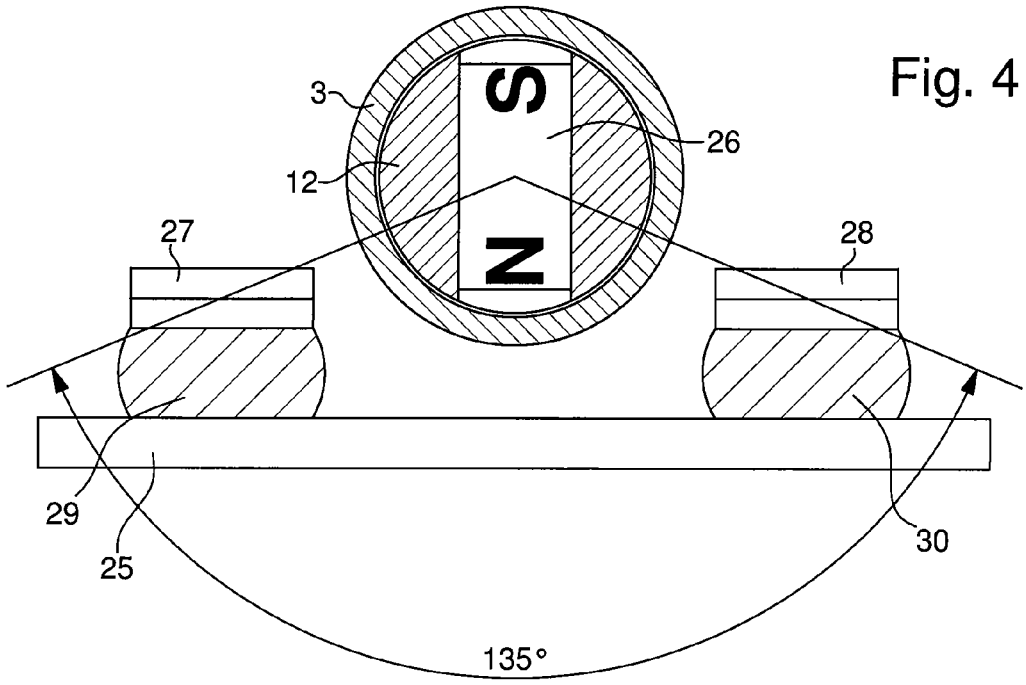
FIG. 4 is a view in transverse section according to the axis IV-IV of FIG. 1.

If reference is made again to FIG. 1A, it is seen that the represented control device comprises a second magnet (reference number 26) which is situated opposite a third and a fourth MR (respectively with the reference numbers 27 and 28). As can be seen in FIG. 4 likewise, the magnet 26 is inserted into a transverse passage formed in the stem 12. In the present example, the MR 27 and 28 are mounted on supports 29, 30 which themselves are fixed on the support plate 25 which already carried the two first MR 22 and 23. On the other hand, the MR 27 and 28 have their axis orientated perpendicular to the axis of the stem 12 and are disposed symmetrically on both sides of the projection of the axis of the stem 12 on the plate 25, in the immediate vicinity of the sealed tube 3.

The magnet 26 and the MR 27 and 28 are provided in order to detect the rotations of the stem 12. When the wearer of the watch turns the button 13, he drives the second magnet 26 in rotation in a plane which is transverse to the axis of the stem 12. The rotation of the magnet 26 causes a cyclic succession of openings and closings of each of the two MR 27 and 28. It will be understood that the MR open and close twice during each turn of the magnet. The MR 27 and 28 therefore commutate with a frequency of two cycles per turn, and the period separating two consecutive closures (or two openings) of the same MR corresponds therefore to a rotation of 180° of the stem 12. Furthermore, the two MR 27 and 28 switch with the same frequency, and it will be understood that this frequency depends upon the speed of rotation of the stem.

As shown again in FIG. 4, the two MR 27 and 28 form together an angle of approx. 135° relative to the axis of rotation of the stem 12. A complete cycle accomplished by one of the MR corresponding to 180°, the 135° of offset between the MR 27 and the MR 28 correspond to three-quarters of a cycle. This angular offset is manifested in a phase shift of n/2 (or −n/2) between the cycles of the two MR. The sign of this phase shift, or in other words the order in which the MR open and close, gives the direction of rotation of the stem 12.

The person skilled in the art will understand that, according to a simplified variant, a single reed contact (MR 27 or MR 28) suffices to detect the rotations of the stem 12. In fact, as has been seen, the use of two angularly offset MR makes it possible to detect the direction of rotation of the stem. However, in the applications for which it is not necessary to distinguish between one direction of rotation and the other, it suffices that the electronic circuit of the watch has access to the switchings of a single MR.

If reference is made again to FIG. 1A, it can be noted again that, in the drawing, the MR 27 and 28 are not placed exactly facing the magnet 26. In fact, in the present example, the MR 27 and 28 are provided in order to cooperate with the magnet 26 not only when the stem 12 is in the resting position (position 0) as in FIG. 1A but likewise when the stem is pulled (position 1). This is the reason for which a slight offset is provided between the MR and the second magnet. The contacts are in fact placed halfway between the position of the magnet in the pulled position of the stem, and the position of the magnet in the resting position.

The watch equipped with the magnetic control device of the present example comprises in particular, in the normal manner, electronic means (not represented) comprising a time base, and display means controlled by these electronic means. The four magnetic sensors (the MR 22, 23, 27 and 28) are connected to electronic means in a manner known to the person skilled in the art. The electronic means are provided in order to detect the state of each of the magnetic sensors, and to process this information as four binary signals. Because of concerns of generality, the binary expressions "yes" and "no" have been preferred to the expressions "open" and "closed" in order to designate in the Figures the state of a magnetic sensor according to the invention.

What is claimed is:

1. A magnetic control device of a timepiece comprising:

a moveable control member that can be actuated manually from outside of the timepiece; and a first magnet that is fixed to the control member, the first magnet is provided in order to be displaced in translation on a trajectory connecting at least three predefined positions when a wearer of the timepiece manipulates the control member;

detection means situated inside the timepiece and provided in order to detect, amongst the three predefined positions, the position occupied by the first magnet, the detection means comprising at least one first magnetic sensor and one second magnetic sensor that are able to be in a first state or a second state, and are disposed in the vicinity of the trajectory of the first magnet in order to cooperate with the first magnet;

a sealed tube that has a wall produced in a non-magnetic material, the sealed tube comprising a distal blind end that extends towards an inside of the timepiece and a proximal end that opens towards the outside of the timepiece, wherein the control member has a general form of a stem provided in order to slide inside the sealed tube and wherein the first magnet is provided in order to be displaced inside the tube solid with the stem, the first magnetic sensor and the second magnetic sensor are disposed spaced-apart along the sealed tube in order that the three predefined positions of the first magnet are respectively associated with three different combinations of a first sensor state with a second sensor state.

2. The device according to claim 1, wherein the north-south axis of the first magnet is orientated coaxially to the stem.

3. The device according to claim 1, wherein the axes of the first magnetic sensor and of the second magnetic sensor are orientated parallel to the longitudinal axis of the sealed tube.

4. The device according to claim 1, wherein the first magnetic sensor and the second magnetic sensor are offset angularly one relative to the other relative to the longitudinal axis of the sealed tube.

5. The device according to claim 1, wherein the first magnetic sensor and the second magnetic sensor are mounted on the same printed circuit, the printed circuit being parallel to the longitudinal axis of the sealed tube.

6. The device according to claim 1, wherein the stem is provided in order to turn inside the sealed tube and wherein the electronic detection means are provided in order to detect likewise the rotations of the stem.

7. The device according to claim 6, wherein the detection means further comprises at least one third magnetic sensor that is provided in order to cooperate with a second magnet that is rigidly fixed to the stem and orientated transversely relative to the axis of rotation of the stem.

8. The device according to claim 6, wherein the detection means further comprises a third magnetic sensor and a fourth magnetic sensor that are offset angularly relative to the axis of rotation of the stem, the third magnetic sensor and the fourth magnetic sensor are provided in order to cooperate with a second magnet that is rigidly fixed to the stem and orientated transversely relative to the axis of rotation of the stem.

9. The device according to claim 8, wherein the third magnetic sensor and the fourth magnetic sensor are offset angularly by approximately 135°.

10. The device according to claim 1, wherein the sealed tube is provided with a sealing joint that is disposed near the proximal end, and the sealing joint is provided in order to ensure a seal between the tube and a middle part of the timepiece.

11. The device according to claim 1, wherein the first magnetic sensor is in a first yes state and the second magnetic sensor is in a second no state when the first magnet occupies a first predefined position, and wherein the first magnetic sensor and the second magnetic sensor are in the same state when the first magnet occupies a predefined second position, and wherein the first magnetic sensor is in the second no state and the second sensor in the first yes state when the first magnet occupies a third predefined position.

12. The device according to claim 1, wherein the first magnetic sensor and the second magnetic sensor are each in a first yes state when the first magnet occupies a predefined first position, wherein the first magnetic sensor and the second magnetic sensor are in different states when the first magnet occupies a second predefined position, and wherein the first magnetic sensor and the second magnetic sensor are each in a second no state when the first magnet occupies a third predefined position.

13. The timepiece comprising a magnetic control device according to claim 1.

14. The device according to claim 1, wherein the timepiece is a watch.

15. The device according to claim 1, wherein the first state is a yes or no and the second state is a yes or no.

* * * * *